US011034118B2

(12) United States Patent
De Boer et al.

(10) Patent No.: US 11,034,118 B2
(45) Date of Patent: Jun. 15, 2021

(54) METHOD AND SYSTEM FOR CREATING CUSTOM-SIZED PACKAGING BOXES AND FOR AUTOMATICALLY PACKAGING ITEMS

(71) Applicant: NEOPOST TECHNOLOGIES, Bagneux (FR)

(72) Inventors: Fokke De Boer, Drachten (NL); Eelke Visser, Drachten (NL)

(73) Assignee: QUADIENT TECHNOLOGIES FRANCE, Bagneux (FR)

( * ) Notice: Subject to any disclaimer, the term of this patent is extended or adjusted under 35 U.S.C. 154(b) by 0 days.

(21) Appl. No.: 16/759,214

(22) PCT Filed: Oct. 26, 2018

(86) PCT No.: PCT/EP2018/079514
§ 371 (c)(1),
(2) Date: Apr. 24, 2020

(87) PCT Pub. No.: WO2019/081773
PCT Pub. Date: May 2, 2019

(65) Prior Publication Data

US 2020/0307140 A1 Oct. 1, 2020

(30) Foreign Application Priority Data

Oct. 26, 2017 (DE) ..... 10 2017 125 072.7

(51) Int. Cl.
*B31B 50/00* (2017.01)
*B65B 5/02* (2006.01)
(Continued)

(52) U.S. Cl.
CPC ..... *B31B 50/006* (2017.08); *B31B 50/20* (2017.08); *B31B 50/262* (2017.08); *B65B 5/024* (2013.01);
(Continued)

(58) Field of Classification Search
CPC ..... B31B 50/00; B31B 50/006; B31B 50/20; B31B 50/262; B31B 2100/0024;
(Continued)

(56) References Cited

U.S. PATENT DOCUMENTS 10,583,943 B2 * 3/2020 Feijen ..... B65B 5/02
2015/0119216 A1 * 4/2015 Benterman ..... B26D 5/00 493/22

(Continued)

FOREIGN PATENT DOCUMENTS

EP 2951099 A1 12/2015
FR 2987824 A1 9/2013
WO 2014117817 A1 8/2014

OTHER PUBLICATIONS

FEFCO International Fibreboard Case Code, 11th edition, published by FEFCO, Belgium, 2007, 72 pages.

(Continued)

*Primary Examiner* — Hemant Desai
*Assistant Examiner* — Jacob A Smith
(74) *Attorney, Agent, or Firm* — Cozen O'Connor

(57) ABSTRACT

Method and system for making custom-sized open packaging boxes from cardboard having a width $W_{CBB\ and}$ corresponding separate closing lids from cardboard having a width $W_{CBL}$, the cardboard being continuously supplied to a system comprising structure for cutting, creasing and folding the cardboard to form custom-sized boxes and corresponding lids such that each box comprises a rectangular bottom panel having four edges, a first and a second rectangular end panel joined via respective crease lines to opposite edges of said bottom panel, a first and a second rectangular side panel joined via respective crease lines to opposite edges of said bottom panel, two first and two
(Continued)

second rectangular corner panels, the first corner panels joined via respective crease lines to opposite edges of the first end panel, and the second corner panels joined via respective crease lines to opposite edges of the second end panel, each lid comprises a rectangular top panel having four edges, a first and a second rectangular end panel joined via respective crease lines to opposite edges of said top panel, a first and a second rectangular side panel joined via respective crease lines to opposite edges of said top panel, optionally two first and two second rectangular corner panels, the first corner panels joined via respective crease lines to opposite edges of the first end panel and the second corner panels joined via respective crease lines to opposite edges of the second end panel, said method comprising: a step of obtaining information on the desired minimum inner dimensions length $L_D$, height $H_D$ and width $W_D$ of a box to be created, a calculating step of calculating the dimensions of the panels of a box and of the panels of a lid on the basis of the desired minimum dimensions taking into account predetermined optimization criteria, and a step of creating the box and the lid, wherein said calculating step comprises allowing the inner height of the side panels of the box to be smaller than the desired inner height of the box if $(W_D+2T_{CBB}+2H_D)>(W_{CBB}-M_B)$, wherein MB denotes an optional minimum margin that is cut off at the sides of the cardboard supplied and wherein $T_{CBB}$ denotes a material dependent correction factor generally corresponding to the thickness of the cardboard used for the box, and/or if $2H_D>L_D$ and choosing the inner height of the side panels of the lid template so that the inner height of the side panels of the box plus the inner height of the side panels of the lid equals at least the desired height.

19 Claims, 8 Drawing Sheets

(51) Int. Cl.
*B31B 50/20* (2017.01)
*B31B 50/26* (2017.01)
*B31B 100/00* (2017.01)
*B31B 110/35* (2017.01)
*B31B 120/10* (2017.01)

(52) U.S. Cl.
CPC ... *B31B 2100/0024* (2017.08); *B31B 2110/35* (2017.08); *B31B 2120/10* (2017.08); *B65B 2210/04* (2013.01)

(58) Field of Classification Search
CPC ..... B31B 2110/35; B31B 2120/10; B31B 2121/10; B65B 57/02; B65B 5/024; B65B 5/028; B65B 57/04; B65B 57/06; B65B 57/08; B65B 57/28; B65B 43/10; B65B 57/10; B65B 57/12; B65B 59/00; B65B 59/003; B65B 2210/04; B65D 5/0005
USPC ..... 53/52, 66, 396, 456, 493, 503, 504; 493/51, 52, 68, 70, 79
See application file for complete search history.

(56) References Cited

U.S. PATENT DOCUMENTS

2015/0197364 A1* 7/2015 Sytema ..... B65D 5/2052 229/181
2015/0360801 A1* 12/2015 Sytema ..... B65B 43/10 53/74
2015/0367974 A1* 12/2015 Sytema ..... B65B 57/12 53/461
2017/0001746 A1* 1/2017 Dominici ..... B65B 59/001
2018/0050833 A1* 2/2018 Sytema ..... B65B 51/02
2018/0134421 A1* 5/2018 Ponti ..... B65B 5/06
2019/0092513 A1* 3/2019 de Boer ..... B31B 50/006
2019/0193886 A1* 6/2019 Brizzi ..... B65B 59/005

OTHER PUBLICATIONS

International Search Report and Written Opinion for PCT/EP2018/079514, dated Mar. 8, 2019, 13 pages.

* cited by examiner

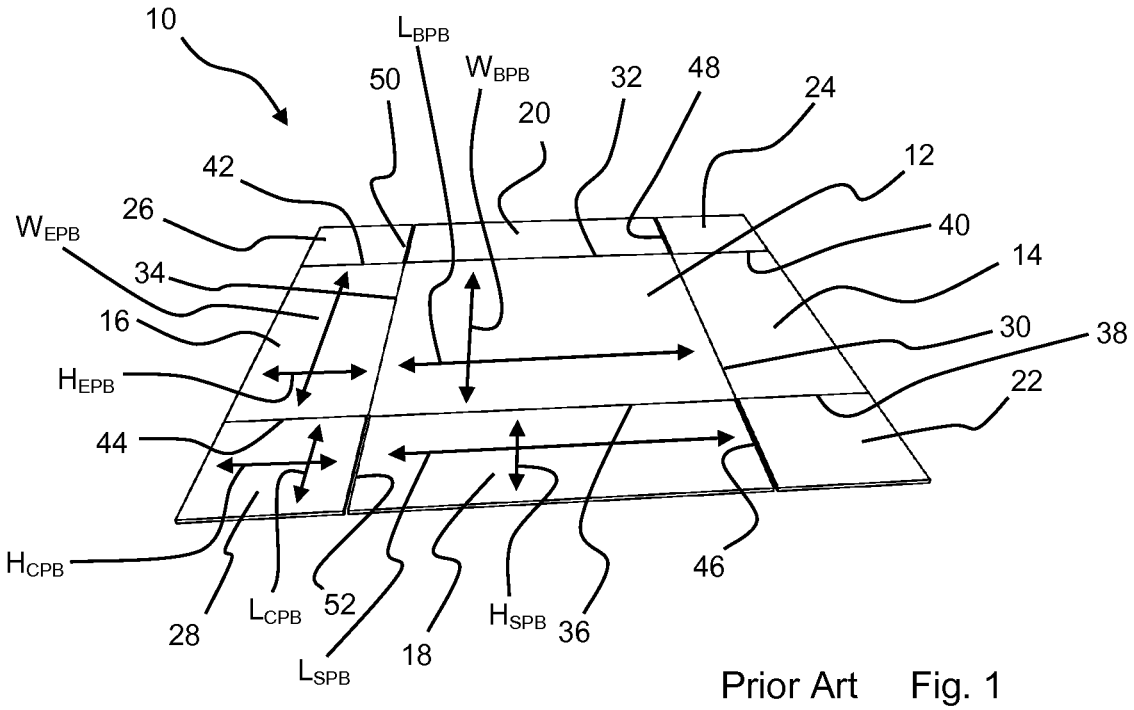
Prior Art Fig. 1
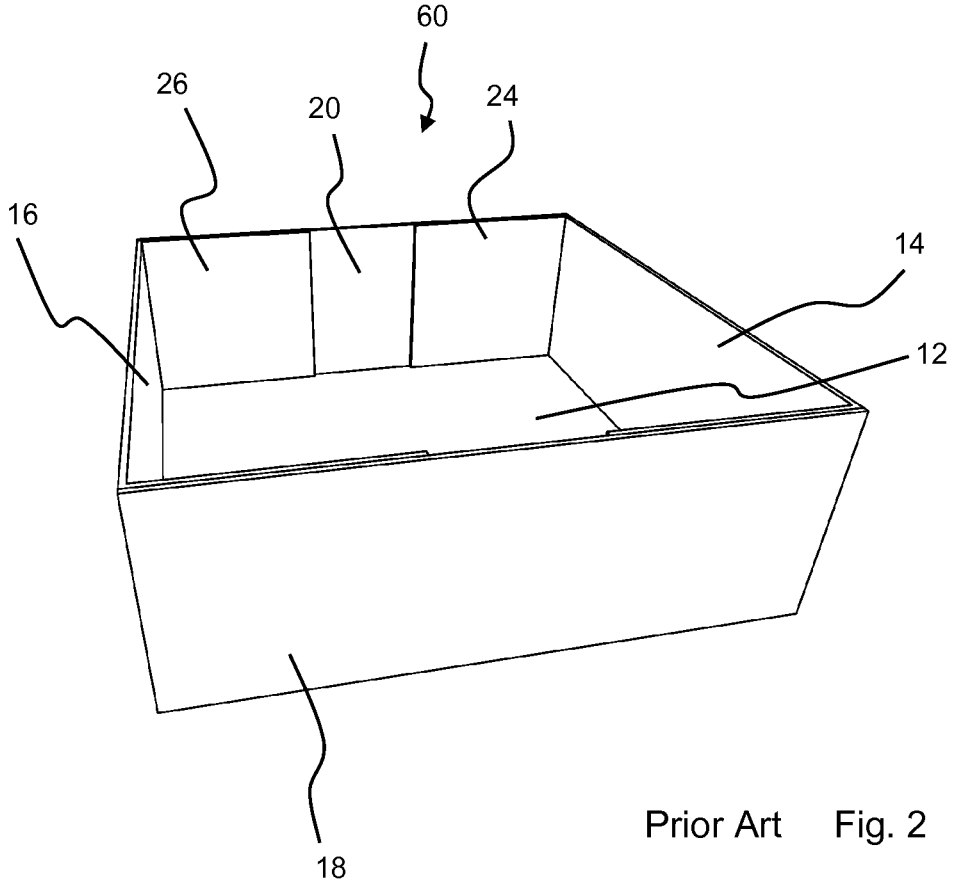
Prior Art Fig. 2

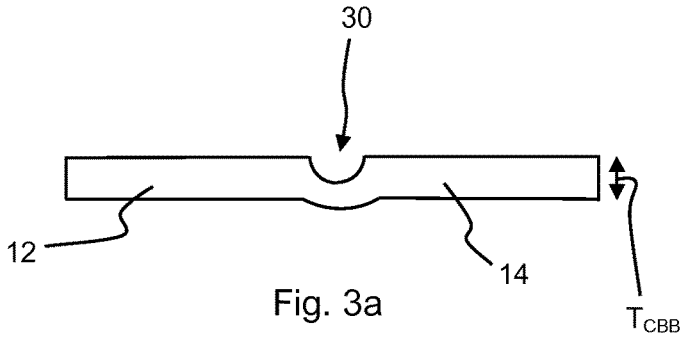
Fig. 3a
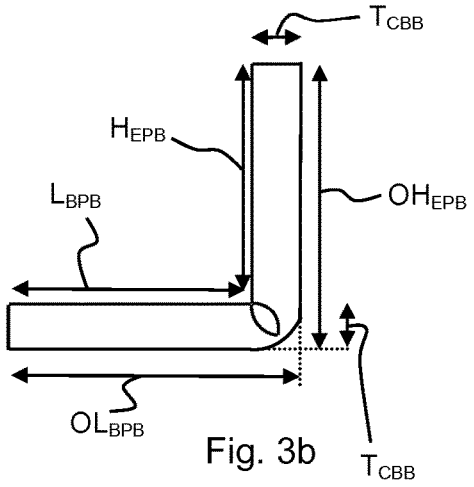
Fig. 3b
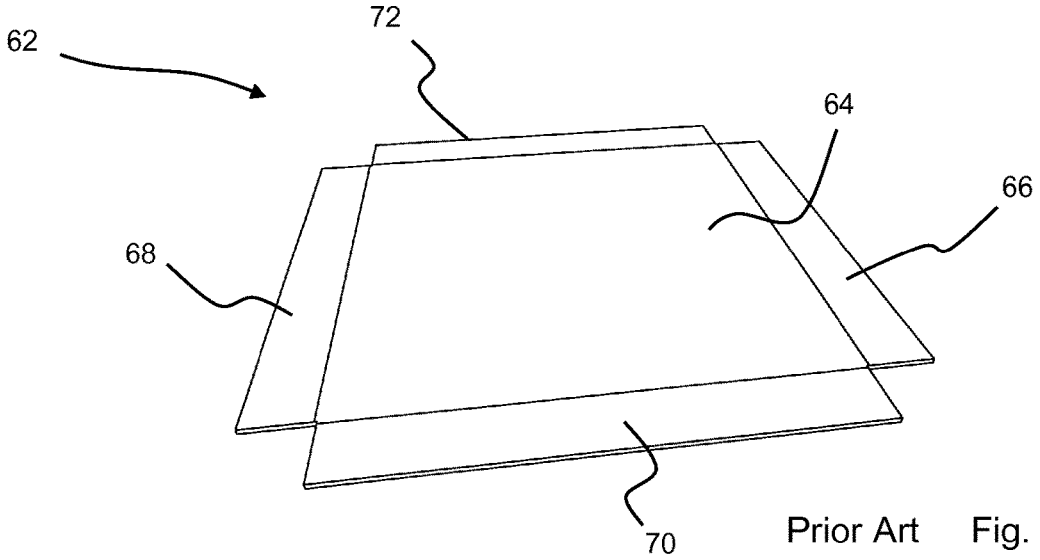
Prior Art Fig. 4
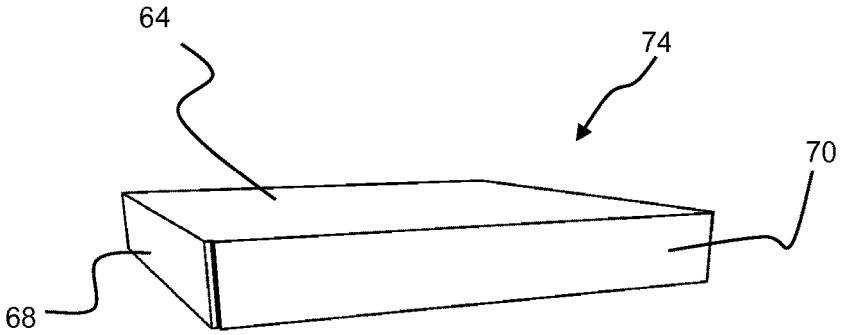
Prior Art Fig. 5

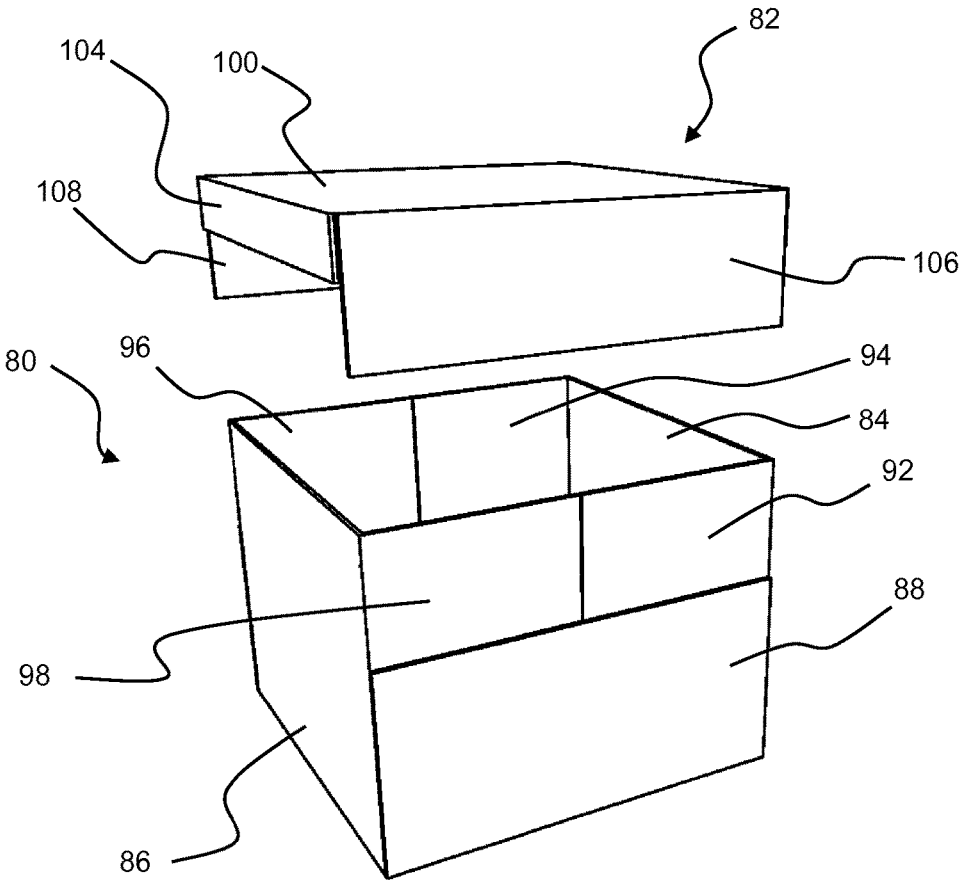
Fig. 6
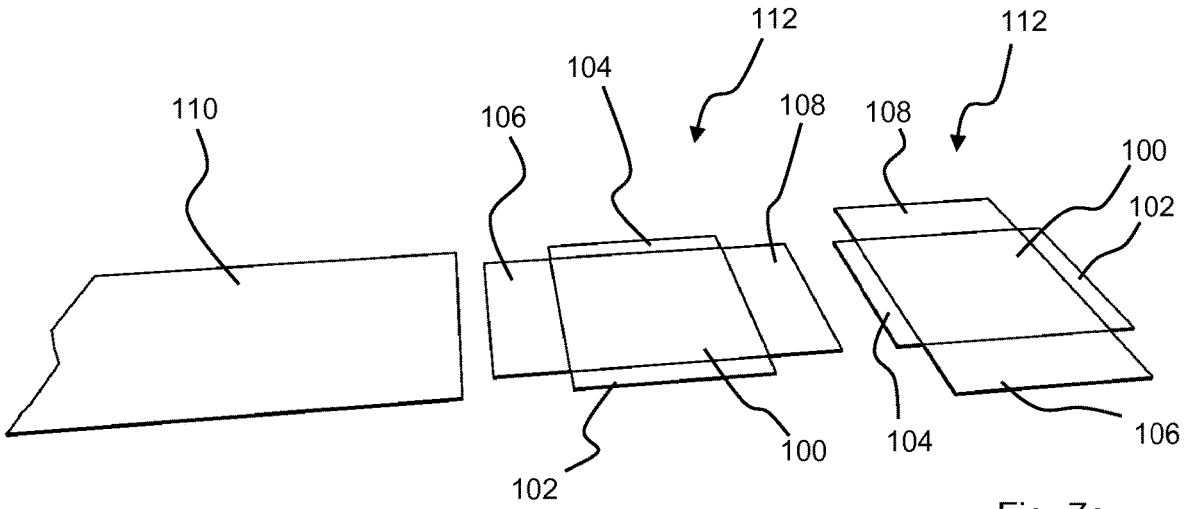
Fig. 7a
Fig. 7b
Fig. 7c

METHOD AND SYSTEM FOR CREATING CUSTOM-SIZED PACKAGING BOXES AND FOR AUTOMATICALLY PACKAGING ITEMS

TECHNICAL FIELD

The application relates to a method and a system for creating custom-sized open packaging boxes and corresponding separate closing lids from cardboard that is supplied to a system comprising structure for cutting, creasing and folding the cardboard to form custom-sized boxes and corresponding closing lids. The application also relates to a method and a system for automatically packaging items of varying size and number in said custom-sized boxes.

TECHNICAL BACKGROUND

Mail ordering has become a widely used way of buying goods. More and more companies offer virtual department stores, in which the customers can electronically put goods in a shopping cart that later will be transferred by the respective company into a dispatch order, so that in a warehouse a shipment comprising the items ordered (and sometimes additional items such as samples, vouchers, invoices, void-fill etc.) can be assembled based on the respective dispatch order.

While assembling a shipment in a warehouse of a specialized distributor is nowadays often done more or less fully automated, packaging the items to be shipped is still a challenge, in particular when a shipment comprises several items of different sizes and in different quantities. Often, the items to be packaged are provided automatically to a person packaging the items manually. Depending on the size and number of the items, the person selects a suitable box size. Generally the box is a cardboard box that upon packaging is assembled from a corresponding cardboard blank.

To automate the packaging process even in cases where the items vary in size and number, a system has been proposed in WO 2014/117817 A1 that allows—within the boundaries imposed by the material used—creating a fully custom-sized box, i.e. a box, of which width, length and height are adapted to the respective content of the box. The box is created from a roll or a stack of cardboard by cutting out and creasing a custom-sized blank from which the box including panels to form a lid is folded automatically around the item(s) to be packaged after placing the item(s) on the blank.

WO 2016/059218 A1 discloses a system and a method for automatically packaging items varying in size and number applying two separate packings, namely an inner packing surrounding the items to be packaged in a first direction, and an outer packing surrounding the inner packing in a second direction, said second direction being substantially perpendicular to the first direction such that the inner and the outer packing form a combined package enclosing the package items from all sides.

WO 2013/117852 A1 discloses a system and a method for reducing the height of a cardboard box to the apex of the highest item in the box. WO 2013/117852 A1 discloses prefolded boxes, of which also only one dimension, namely the height, can be adapted to the actual content of the box. However, if only one dimension of a box can be adapted, the finished package will often not be optimal with respect to volume, while transportation costs often depend not only on the weight, but also on the volume of a package.

FR 2 987 824 A1 discloses blanks for manually folding boxes and corresponding lids, wherein each blank comprises numerous perforated lines/indentations and cuts to facilitate folding a box and a corresponding lid having different dimensions. As a broad variety of possible boxes and lids can be formed with the blanks according to FR 2 987 824 A1, different sections formed by the perforated lines and cuts are coloured differently to allow the user to identify, which sections have to be folded in order to create a box or a lid of a certain size. Due to the high number of perforated lines and cuts, the stability of a corresponding box and a lid is not optimal. Moreover, producing such coloured blanks with numerous perforated lines and cuts is complex and hence expensive.

While the known systems and methods for automating the packaging process work well for a number of applications, and in particular the system disclosed in WO 2014/117817 A1 has proven to allow packaging items varying in size and number fully automatically, it has turned out that there is a need for optimization of the packaging process under a number of aspects. For example, the known systems for automatically creating custom-sized cardboard boxes with attached lids fold and close the box around the items that have been placed on a corresponding blank. The blank itself has a rather complex structure and accordingly the structure for cutting, creasing and folding is not simple. Moreover, as the boxes are closed by the systems, only the items that have been put on the blank can be packaged, while it is in some cases desirable to fill a box with loose fill material like expanded polystyrene peanuts. Such material would fall off easily or fly about during folding the boxes if placed together with the items on a blank. Hence, a special and complex introduction nozzle or the like would be needed to put such material in a box during the folding and closing process.

The "International Fibreboard Case Code" published by FEFCO and ESBO, 2007, $11^{th}$ edition, discloses under item 0300 a box (hereinafter referred to as "type 0300" box) according to the preamble of claim 1, which is very stable and yet very easy to manufacture as the layout of the so called blank (sometimes called template or piano), which is made by cutting and creasing cardboard of a certain thickness, that can be denoted by $T_{CBB}$ (while as will be explained later $T_{CBB}$ has to be be regarded as a correction factor for taking into account differences between the inner and the outer dimensions of a box) and from which then the box is folded, is rather simple. Each box comprises a rectangular bottom panel having four edges, an inner length $L_{BPB}$ and an inner width $W_{BPB}$, a first and a second rectangular end panel, each joined over a crease line to opposite edges of said bottom panel, each end panel having a an inner width $W_{EPB}$ and an inner height $H_{EPB}$, a first and a second rectangular side panel, each joined over a crease line to opposite edges of said bottom panel, each side panel having an inner length $L_{SPB}$ and an inner height $H_{SPB}$, two first and two second rectangular corner panels, the first corner panel joined over respective crease lines to opposite edges of the first end panel, and the second corner panels joined over respective crease lines to opposite edges of the second end panel, each corner panel having an inner length $L_{CPB}$ basically corresponding to the height $H_{SPB}$ of the side panels plus thickness $T_{CBB}$ of the cardboard the of the box and an inner height $H_{CPB}$ basically corresponding to the height $H_{EPB}$ of the end panels plus the thickness $T_{CBB}$ of the cardboard of the box. It should be noted that due to the thickness of the cardboard, the so-called crease line are not thin lines as for folding paper, but are rather "crease grooves". However, following the terminology common in the art, the term crease line is used herein.

As will be explained in conjunction with the drawings, the so-called outer dimensions, which refer to the dimensions of the panels on the outside of the erected box, either correspond to the respective inner dimensions, if the respective dimension is taken between two free edges of the respective panel like the outer length of the side panels, or basically correspond to the respective inner dimensions plus the thickness $T_{CBB}$ of the cardboard, if the respective outer dimension is taken between a free edge of the respective panel and a panel folded by 90° from the respective panel like the outer length of the end panels, or basically correspond to the respective inner dimensions plus twice the thickness $T_{CBB}$ of the cardboard, if the respective outer dimension is taken between two panels folded by 90° from the respective panel like the outer length of the bottom panel. However, cardboard is to a certain extent flexible and stretchable and has a specific way of behaving upon folding, such that creasing and folding cardboard is not the same as for example mitre cutting adjacent edges of metal profiles and hence all dimensions have some material-caused tolerance. Thus, the dimensions given in the application are to be taken as is common in the art as being not exact values but rather values that allow the operator of a system to implement the invention. Systems for automatically cutting, creasing and folding take the properties of the cardboard into account and even if the dimensions of the items to be packed can be measured very precisely, the boxes are always produced with appropriate tolerance. Nevertheless, for calculating the dimensions of the panels, the following can be assumed to be roughly true: outer length of bottom panel≈$L_{BPB}$ plus 2 $T_{CBB}$, outer width of bottom panel≈$W_{BPB}$ plus 2 $T_{CBB}$, outer width of end panel≈$W_{EPB}$ plus 2 $T_{CBB}$, outer height of end panel≈$W_{BPB}$ plus 1 $T_{CBB}$, outer height of side panel≈$H_{SPB}$ plus 1 $T_C$, outer length of cornel panel≈$L_{EPB}$ plus 1 $T_{CBB}$. As the following dimensions are measured between two free edges of the respective panels, there is no difference between the inner and the outer dimensions: outer length of side panel=$L_{SPB}$, outer height of corner panel=$H_{CPB}$.

The boxes can be closed for example with a lid having the same structure, i.e. a lid with corner panels, or with a lid having an even simpler blank layout in which the corner panels are cut away similar to the lid shown under item 0302 in said FEFCO/ESBO publication ("type 0302" lid). Such lid comprises a rectangular top panel having four edges and an inner length $L_{TPL}$ and an inner width $W_{TPL}$, a first and a second rectangular end panel, joined to opposite edges of said top panel, each end panel having a inner width $W_{EPL}$ and an inner height $H_{EPL}$, a first and a second rectangular side panel joined to opposite edges of said top panel, each side panel having an inner length $L_{SPL}$ and an inner height $H_{SPL}$. Optionally, the lid may also comprise two first and two second rectangular corner panels, the first corner panels joined to opposite edges of the first end panel and the second corner panels joined to opposite edges of the second end panel, each corner panel having an inner length $L_{CPL}$ and an inner height $H_{CPL}$ ("type 0300" lid). The lid may be created from the same cardboard as the box or from a different cardboard. Hence, for the lid a correction factor $T_{CBL}$, which generally corresponds to the thickness of the cardboard of the lid, has to be taken into account and with respect to the outer dimensions of the panels of the lid, corresponding assumptions as for the box can be made.

Known systems for creating custom-sized open packaging boxes and corresponding separate closing lids from cardboard being continuously supplied to the systems, in particular from stacks from zig-zag folded cardboard, can be set up to produce type 0300 boxes and corresponding lids (both having so called corner panels) or combinations of such boxes with e.g. type 0302 lids (having no corner panels). For erecting such a box, the system would first fold the corner panels upwards, then the end panels upwards and thus the corner panels, which are joined to the end panels, inwards, and finally the side panels upwards.

However, although advantageous in stability and simplicity of layout design, the type 0300 box layout has two strong limitations: as the inner height of the side panels (plus the correction factor $T_{CBB}$, which however generally is small compared to the dimensions of the panels) basically corresponds to the length of the corner panels (as the crease line between the corner panels and the end panels, which determines the inner length if the corner panels, is slightly shifted towards the respective end panel to allow that the corner panels and the side panels can both be erected properly), and the height of the end panels corresponds to the inner height of the side panels, the inner height of the side panels and the end panels is limited to half the inner length of the bottom panel, as otherwise the adjacent corner panels of opposite end panels could collide upon erecting the box and would also overlap in the erected state so that they would no longer lie in the same plane, making attaching the side panels difficult and leading to not only visually disadvantageous boxes. Cutting off the corner panels would make the box less stable and would also need an additional step of attaching a closing strip over the edge between adjacent side and end panels. Also, the width of the cardboard supplied limits the outer width and the outer height of a type 0300 box created from such cardboard, as the outer width of the bottom panel plus twice the outer height of the side panels, which corresponds to the outer height of the end panels, cannot be greater than the cardboard width.

SUMMARY

Having regard to the advantages of boxes having separate closing lids and a simple yet stable design comprising a bottom panel, two end panels, two side panels and four corner panels, and being automatically created from cardboard supplied from a stack or a roll of cardboard, it is an object of the invention to disclose a method and a system for creating custom-sized boxes of said design, which overcome both restrictions, i.e. the restriction that the maximum height of the box is limited to half the length of the box, and the restriction that the box width plus twice the box height cannot be greater than the width of the cardboard supplied. Another object of the invention is to disclose a method and a system for automatically packaging items of varying size and number in such custom-sized boxes.

The invention is based on the surprising idea that by allowing, if necessary, the side panels of a box to have a height smaller than the height of end panels and by compensating the missing height of the side panels of the box by increasing the height of the side panels of the lid as necessary to avoid that the closed box would have a lateral opening, custom-sized stable boxes without the aforementioned restrictions can be formed at very high speed. For example, a typical system according to the invention allows to package about 1,000 sets of items varying in size and number per hour.

The invention allows one to overcome—of course within the boundaries of the supplied material having a certain width and a certain strength—the restriction imposed on the height by the length of the box and the restriction imposed on the width and height of the box by the width of the cardboard supplied. It ensures easy erecting of the corner panels without the danger that opposite corner panels could collide, and ensures that erected opposite corner panels are in the same plane, making it easy to attach the side panels to them. Besides, providing separate boxes and lids instead of wrapping cardboard around an assembly of items to be shipped allows e.g. visual inspection of the so called shipment set (the one or more items to be shipped), makes it easy to add loose fill material and other items that originally not formed part of the shipment set like vouchers, product samples, invoices, void-fill etc., and allows that the items are manually re-arranged if wanted. It also allows that the box is produced based on a dispatch order and that the items are assembled in the box upon picking up the items in a warehouse such that they do not have to be transferred onto a cardboard blank. The invention allows creating a fully custom-sized box, i.e. a box, of which the height, length and width are adapted to the needs of a specific shipment set, and which box can be optimized under predetermined criteria like for example minimum volume or maximum stability.

It should be noted that the term "width of the bottom panel" as used herein refers to the extension of the bottom panel in the direction of the width of the cardboard supplied for making the box, and "length of the bottom panel" refers to extension in the direction of the length of the cardboard supplied, which is also the direction, in which the cardboard is transported to and in a system for creating custom-sized boxes. Seen in this transport direction, the end panels of the box are in front and behind the bottom panel, while the side panels of the box are to the left and the right of said bottom panel.

In the flat state, i.e. before erecting the respective panels, the inner height of the end panels of the box is accordingly the extension of the end panels in the length direction of the cardboard supplied between the free edges of the end panels and the crease line separating the end panels from the bottom panel, and the inner width of the end panels of the box is the extension of the end panels in the width direction of the cardboard supplied between the crease lines separating the end panels from the corner panels. The inner height of the side panels is the extension of the side panels in the width direction of the cardboard supplied between the free edges of the side panels and the crease line separating the side panels form the bottom panel, and the length of the side panels is the extension of the side panels in the length direction of the cardboard supplied between the respective two free edges of each side panel. The inner height of the corner panels is the extension of the corner panels in the length direction of the cardboard supplied between the free edges of the corner panels, and the length of the corner panels is the extension of the corner panels in the width direction of the cardboard supplied between the respective free edges and the crease lines separating the cornel panels from the end panels.

The panels and the dimensions of the lid are named after the corresponding panels and dimensions of the box, while it is possible and, as will be apparent form the following description, in certain cases advantageous, to cut out the lid such that—seen in the transport direction of the cardboard supplied for making the lid, which can be the same as the cardboard supplied for making the box, but which can also be a different cardboard—the side panels are in front and behind the top panel and the end panels are to the left and the right of the top panel. Irrespective of the transport direction, the inner height of the end panels of the lid is, in the final state where the lid is placed on the box, the extension of said end panels from the top panel towards the end panels of the box, the inner width of the end panels of the lid is the extension of said end panels in the direction of the width of the end panels of the box, the inner height of the side panels of the lid is the extension of said side panels from the top panel towards the side panels of the box, and the length of the side panels of the lid is the extension of said side panels in direction of the length of the side panels of the box. If present, the inner height of the corner panels is the extension of the corner panels from the top panel towards the bottom panel, and the inner length of the corner panels of the lid is the extension of said corner panels in the length direction of the cornel panels of the box.

The information on the desired minimum inner dimensions length $L_D$, height $H_D$ and width $W_D$ of a box to be created can be calculated from dimensions of the items to be packaged known from a database or, in a preferred embodiment, by simply putting the items to be shipped on a conveyor belt and transporting the item(s) through a laser scanner which determines the width, height and length of the item or the arrangement of items for which a box shall be created. If $(W_D+2\ T_{CBB}+2H_D)>(W_{CBB}-M_B)$, wherein $M_B$ denotes an optional minimum margin that is cut off at the sides of the cardboard supplied for creating the box, and/or if $2H_D>L_D$, $H_{SPB}$ is then set to fulfil $(2H_{SPB}+2T_{CBB}+W_{BPB})\leq(W_{CBB}-M_B)$ and $2H_{SPB}\leq L_D$ and $H_{SPB}$ to fulfil $H_{SPB}+H_{SPB}\geq H_D$. For the reasons explained above (folding behaviour of the cardboard), $T_{CBB}$, which generally denotes the thickness of the cardboard, can be seen as a certain minimum value between adjacent panels and hence depending on the cardboard can be slightly bigger or smaller than the actual cardboard thickness.

In a preferred embodiment, the inner height $H_{SPB}$ is, if $(W_D+2\ T_{CBB}+2H_D)>(W_{CBB}-M_B)$ and/or if $2H_D>L_D$, set to fulfil—within the box related limitation $2H_{SPB}\leq L_D$ and the typical material-caused tolerances—$(2H_{SPB}\ 2T_{CBB}+W_{BPB})=(W_{CBB}-M_B)$. This means that the side panels either can have the full inner height of the box, and/or if twice the needed inner height of the box exceeds the needed length of the box, so that the corner panels would collide, are reduced in height while nevertheless no waste material other than the optional minimum margin $M_B$ that is cut off at the sides of the cardboard supplied for creating the box is produced. In this respect, it should be noted that the minimum margin $M_B$ typically has values between 0 and 80 mm, preferably between 20 and 60 mm, and depends on different factors like for example the quality of the cardboard supplied. Sometimes the edges of the cardboard are slightly damaged during transportation so that cutting of a certain margin at the edges ensures not only proper edges for handling the cardboard, but also creating boxes that are visually faultless. Likewise, it is possible to cut off an optional minimum margin $M_L$ at the sides of the cardboard supplied for creating the lid. If in that case either $(L_{TPL}+2T_{CBL}+2H_{EPL})\leq(W_{CBL}-M_L)$ or $(W_{TPL}+2T_{CBL}+2H_{SPL})\leq(W_{CBL}-M_L)$, it is possible to set $H_{SPL}$ and $H_{EPL}$ to be equal, which gives the box a symmetric and hence generally appealing look.

If both, $(L_{TPL}+2T_{CBL}+2H_{EPL})\leq(W_{CBL}-M_L)$ and $(W_{TPL}+2T_{CBL}+2H_{SPL})\leq(W_{CBL}-M_L)$, it is possible to cut the lid such that the side panels of the lid are in front and behind the top panel and the end panels of the lid are to the left and the right of the top panel seen in the transport direction of the cardboard supplied for making the lid, if $(L_{TPL}+2H_{EPL})>(W_{TPL}+2H_{SPL})$, and such the end panels of the lid are in front and behind the top panel and the side panels of the lid are to the left and the right of the top panel seen in the transport direction of the cardboard supplied for making the lid if $(L_{TPL}+2H_{EPL})<(W_{TPL}+2H_{SPL})$. This allows to minimize the waste material that is produced upon cutting out the lid. Depending on the general setup of a system implementing the method, if $(L_{TPL}+2H_{EPL})=(W_{TPL}+2H_{SPL})$ the lid can be cut either way and the way is chosen, which optimizes the procedure of placing the lid on top of the box. For example, in certain setups the lids and the boxes are produced such that generally the length direction of the boxes is already parallel to the length direction of the lids such that the lids can easily be placed on top of the boxes. In other cases, the length directions of the boxes and the lids are orthogonal such that either the box or the lid would have to be turned by 90° in order to make it possible to place a lid on top of the box. These setups can already be taken into account when choosing the way the lid is cut out to optimize the further procedure.

The boxes and the lids can be made in series from the same cardboard and with the same structure for cutting, creasing and folding. This allows to minimize the space needed for a respective system implementing the method. However, in order to increase the speed and if space needed is not an issue, it can be advantageous to make the boxes and the lids from different cardboards using different structure for cutting, creasing and folding the lids and the boxes. This allows to produce boxes and corresponding lids in parallel. Also, it is possible to provide cardboard with different properties like width, strength and branding for for making the lids and to choose for making a specific lid the cardboard, which allows creating the least waste upon cutting out the lid.

For example, in a typical system implementing the method, the boxes are created from cardboard having a width of 1,000 mm, which is supplied from a stack of zig-zag folded cardboard having a length of e.g. 1,000 m, whereas for the lids three stacks of zig-zag folded cardboard each having a length of 1,000 m and widths of 600 mm, 800 mm and 1,000 mm are provided.

The method can be employed such that, within the typical material caused tolerances, the side panels of the lids and the side panels of the box and/or the end panels of the lid and the end panels of the box abut in the final state of the box with a lid placed on top of it, giving the box a smooth appearance. The abutment line between respective side panels and/or end panels of the box and the lid can be easily closed with an adhesive strip or the like. However, it is also possible to ensure that there is always a certain desired overlap of the side panels of the lid with the side panels of the box and/or of the end panels of the lid and the end panels of the box, which gives a very stable and secure box.

In order to facilitate opening the closed boxes, it is possible to introduce two parallel perforation lines in at least some of the panels of the lid and optionally attaching a tear strip between the parallel perforation lines, allowing a recipient of the closed box to open it easily.

A method for automatically packaging items of varying size and number in custom-sized boxes may comprise the aforementioned steps of creating a custom-sized box blank, putting the item(s) to be packaged on the bottom panel of such blank and then erecting the respective corner, side and end panels of the box and finally closing the box with a corresponding lid. In doing so, the lid can be placed directly on top of the side panels, so that the final height of the box corresponds, of course with the added thickness of the cardboard for the lid, the height of the side panels. However, it is also possible to hold the lid above the box and to attach the side panels of the lid to the side panels of the box and the end panels of the lid to the end panels of the box such that the total height of the box is larger than the height of the side panels, i.e. neither the side panels nor the end panels of the box run up to the full height of the box.

Further advantages, details and features of the invention become apparent from the following detailed description of preferred embodiments in conjunction with the drawing, which comprises 17 figures.

BRIEF DESCRIPTION OF THE DRAWING

FIG. 1 is a perspective view of a blank for a type 0300 box.

FIG. 2 is a perspective view of a box folded from the blank shown in FIG. 1.

FIG. 3 is a schematic diagram explaining the difference between outer and inner dimensions.

FIG. 4 shows a blank for a type 0302 lid.

FIG. 5 is a perspective view of a lid folded from the blank according to FIG. 4.

FIG. 6 is a perspective view of a box and a corresponding lid according to a first embodiment of the invention.

FIGS. 7*a*, 7*b* and 7*c* form a schematic diagram showing how limits of the width of the cardboard supplied for making a lid can be overcome.

DETAILED DESCRIPTION OF PREFERRED EMBODIMENTS

Figure 8:
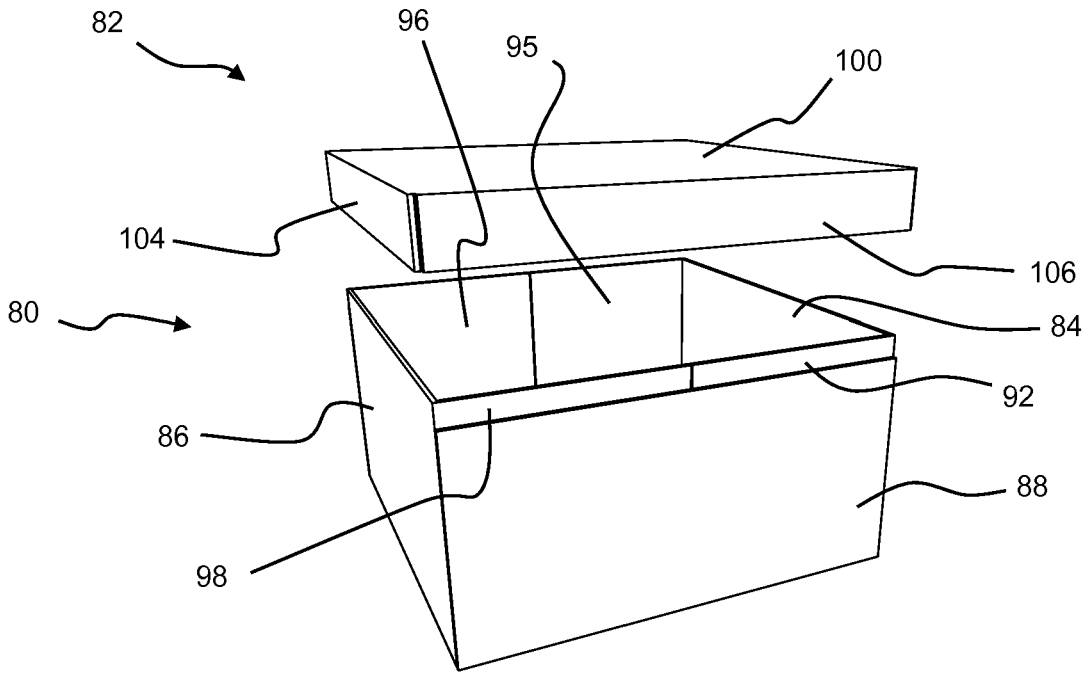
FIG. 8 is a perspective view of a box and a corresponding lid according to a second embodiment of the invention.

FIG. 1 shows a blank 10 for a type 0300 box, having a bottom panel 12, a first end panel 14, a second end panel 16, a first side panel 18, a second side panel 20, two first corner panels 22 and 24 joined to opposite edges of the first end panel 14 and two second corner panels 26 and 28 joined to opposite edges of the second end panel 16. The panels are delimited against each other via eight crease lines 30-44 respectively four slots 46, 48, 50 and 52. The crease lines 38 and 44 are with respect to the crease line 36 slightly shifted, namely to an amount corresponding to the thickness of the cardboard towards the first end panel 14 respectively the second end panel 16. Likewise, the crease 40 and 42 are shifted in an amount corresponding to the thickness of the cardboard towards the first end panel 14 respectively towards the second end panel 16 with respect to the crease line 48. This allows that in the erected state as shown in FIG.

2, the corner panels 22 and 28 run perfectly parallel to the side panel 18 and the corner panels 24 and 26 run parallel to the side panel 20. The slots 46, 48, 50 and 52 are also dimensioned to take into account the thickness of the cardboard: the height $H_{CPB}$ of the corner panels has to be decreased by the thickness of the cardboard as in the erected state these corner panels abut against the bottom panel while the top side of the corner panels shall be level with the top end of the end panels. Due to the material inherent properties, the slots are typically not made such that only the height of the cornel panels is shortened, but also the length of the side panels, which facilitates erecting the box and ensures that the side panels not extend beyond the end panels in the erected state. Hence, the length of the side panels is typically a bit shorter than the length of the bottom panel.

As can be seen in FIG. 2, in this type of box the side panels and the end panels have the same height, which defines the maximum height of this prior art box. This type of box has two limits: as the length $L_{CPB}$ basically (plus $1T_{CBB}$) corresponds to the height $H_{SPB}$, which is the same as the height $H_{EPB}$ of the end panels, the height of the box is limited by the length $L_{BPB}$ of the bottom panel, as 2 $L_{SPB}$ has to be smaller than $L_{BPB}$ in order to avoid a collision of opposite first and second corner panels, i.e. a collision of corner panel 22 with corner panel 28 respectively of corner panel 24 with corner panel 26 upon erecting the box.

The second limitation of this type of box is that if the blank is cut out from cardboard having a certain width $W_{CBB}$ such that the side panels run parallel to the edges of the cardboard, the width of the supplied cardboard limits the height of the box in that $(W_{BPB}+2T_{CBB}+2\ H_{SPB})\leq W_{CBB}$ has to be fulfilled.

FIG. 3 is a very schematic diagram showing a part of bottom panel 12 and end panel 14 explaining the difference between outer and inner dimensions. In theory, the crease line 30 applied to the cardboard in the flat state (FIG. 3*a*) works like a mitre such that in the erected state (FIG. 3*b*), $L_{BPB}+1T_{CBB}\approx OL_{BPB}$ and $H_{EPB}+1T_{CBB}\approx OH_{EPB}$, wherein $OL_{BPB}$ denotes the outer length of the bottom panel and and $OH_{EPB}$ denotes the outer height of the end panel. As explained above, in practice due to the folding behaviour of the cardboard and the inherent properties of the cardboard lead to deviations from theory, which however can easily be taken into account by regarding $T_{CBB}$ (and $T_{CBL}$ for the lid) as a kind of correction factor that can be chosen depending on the actual material used. As apparent from FIG. 3, when folding the side and end panels upwards from a bottom panel or downwards from a top panel, the transition between the panels is usually round and there is no clear end of either of the panels. Hence, if a dimension is not measured between two free ends of a panel, like the length of the side panels, the outer dimension is considered to relate to the dimension between a free end of the respective panel and the respective outer plane of an adjacent orthogonal panel.

FIG. 4 shows a blank 62 for a type 030 lid, which comprises a bottom panel 64, a first end panel 66, a second end panel 68, a first side panel 70 and a second side panel 72. FIG. 5 shows a lid 74 formed from such blank.

In order to overcome the aforementioned limits of the known boxes, the invention allows that the first and second side panels have a height $H_{SPB}$, which is less than the height $H_{EPB}$ of the first and the second end panel of the box and to compensate the limited height of the side panels of the box by increasing the height of the side panels of the lid. FIG. 6 shows a box 80 and a corresponding lid 82 according to a first embodiment of the invention. Again, the box comprises a bottom panel (not visible in this view), a first end panel 84, a second end panel 86, a first side panel 88, a second side panel (not visible in this view), two first corner panels 92 and 94 attached to the first end panel 84 and two second corner panels 96 and 98 attached to the second end panel 86. The lid 82 comprises a top panel 100, a first end panel (not visible in this view), a second end panel 104, a first side panel 106 and a second side panel 108. The dimensions of the side panels of the box and the side panels of the lid are chosen such that they correspond to the height of the box, i.e. that they abut against each other in the closed state.

While FIG. 6 seems to imply that the lid 82 is put on the box 80 in the erected state, i.e. with the side panels and the end panels folded downwards, in an automatic implementation of the inventive method the lid blank with corresponding crease lines to define the respective end panels and side panels is placed on top of the erected box, glue is applied to either or both of the respective panels of the box and the lid, and the end panels and the side panels of the lid are folded downwards and pressed against the respective panels of the box. Of course, instead of glue, sealing the box could be done in other ways for example with adhesive tape.

FIG. 7 is a schematic diagram to show how a limitation implied by a certain cardboard width of the cardboard supplied for making the lid 82 of FIG. 6 can be overcome. If cardboard 110 having a width $W_{CBL}$ is supplied for making the lid and the calculated layout of the lid 82 is such that the height of the side panels 106 and 108, which have been extended to compensate the "missing" height of the side panels 88 of the box 80 (FIG. 6), plus $2T_{CBL}$ plus the width of the lid exceeds $W_{CBL}$(FIG. 7*c*), the layout can simply be rotated as shown in FIG. 7*b*. Thus, the height of the side panels 106 and 108 is no longer limited by the width of the cardboard supplied for the lid. As explained above, depending on the general setup of a system for automatically erecting and placing the lids on a box, it may be necessary to rotate either the box or the lid such that the lid fits on top of the box.

Figure 9:
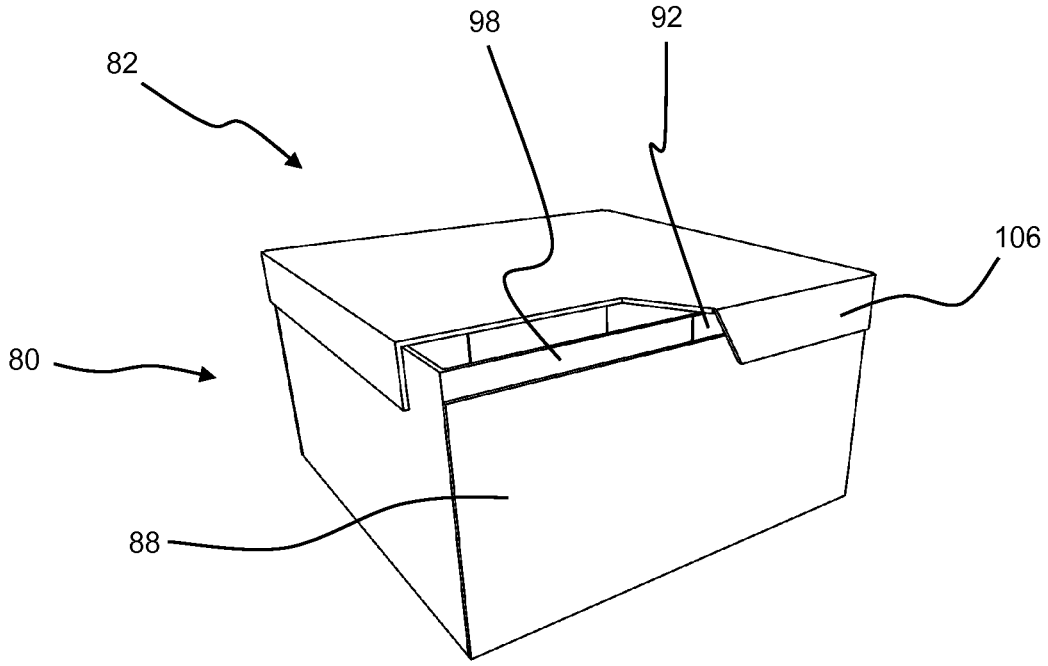
FIG. 9 shows the box and the lid of FIG. 8 in the closed state, wherein a part of the lid has been cut off to show certain details.
Figure 10:
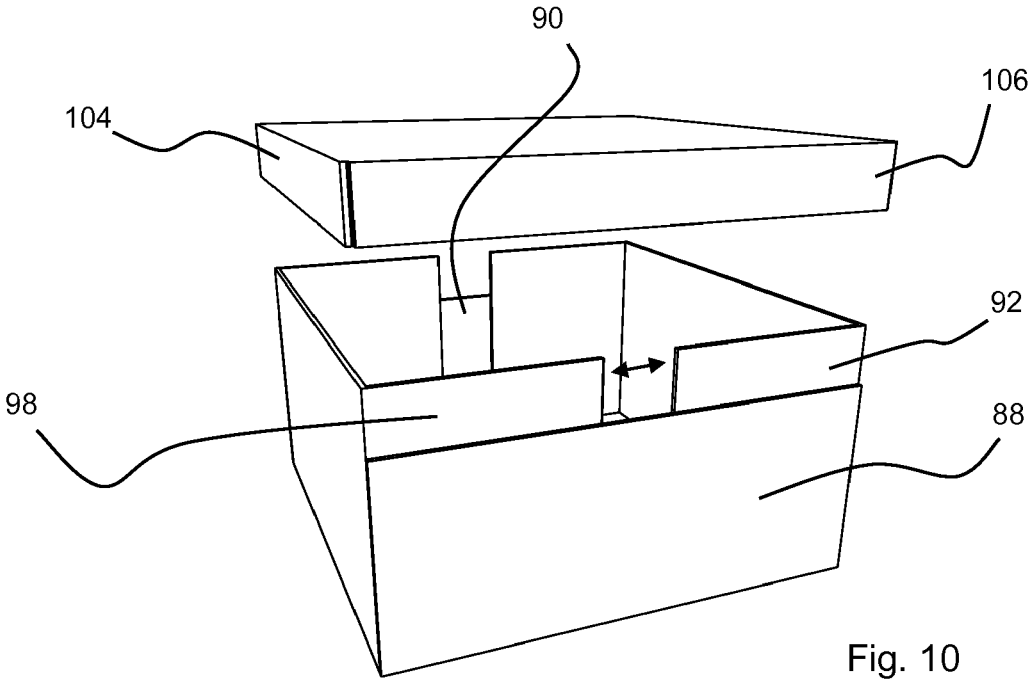
FIG. 10 is a perspective view of a box and a corresponding lid according to a third embodiment of the invention.

FIG. 8 and FIG. 9 show an embodiment of the invention, in which the end panels 104 and the side panels 106 of the lid 82 have the same height. Generally, this gives the box an appealing appearance. Also, it has turned out that due to the properties of the cardboard, it is generally advantageous when the panels have certain minimum dimensions to allow proper handling and folding the panels. For example, the side and end panels of the lid may advantageously have a minimum height of 40-60 mm, which also facilitates gripping and/or holding the panels that might be necessary during the process of creating the lid and the box. As shown in particular in FIG. 9, where the front corner of the lid has been cut away to show details of the box 80 closed with the lid 82, the side panel 106 of the lid overlaps the side panel 88 of the box (and on the opposite, not visible side, the corresponding panels overlap too). Accordingly, the inner width $W_{TPL}$ of the top panel of the lid has to be broader by at least twice the thickness of the cardboard used for the box with respect to the inner width $W_{BPB}$ of the bottom panel of the box to allow that the side panels of the lid run in a plane parallel to the plane of the side panels of the box.

Figure 11:
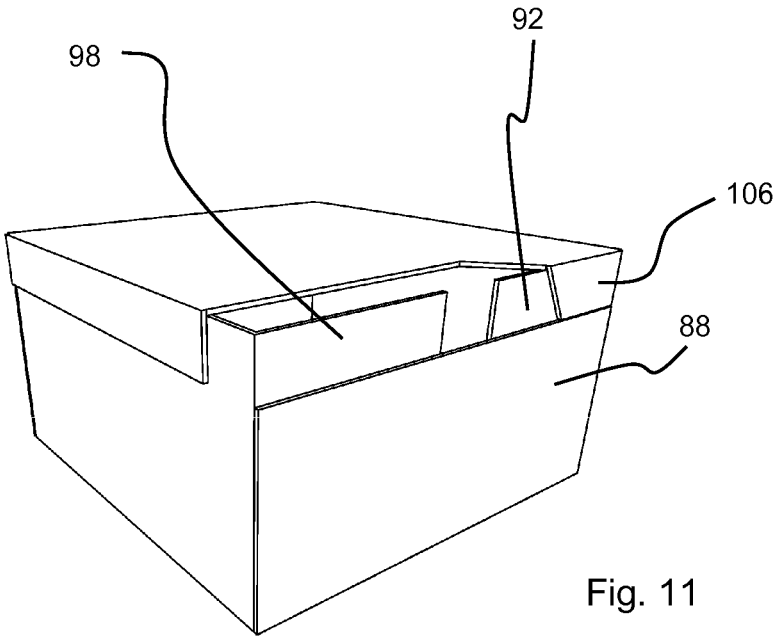
FIG. 11 shows the box and the lid of FIG. 10 in the closed state, wherein a part of the lid has been cut off to show certain details.

Allowing the side panels of the lid to overlap the side panels of the box has also the advantage, that there is no "hole" or "gap" between the facing edges of the side panels of the lid and the side panels of the box and the facing edges of the corner panels. In a situation like the one shown in FIG. 6, where the opposite first and second corner panels 92 and 98 respectively 94 and 96 abut like the side panel 88 of the box and the side panel 106 of the lid, at the point, where the abutting lines of the side panels and the corner panels meet, an infinitesimal hole is formed, which forms a weak point of the box. In a situation like the one shown in FIG. 11, where the opposite first and second corner panels 92 and 98 do not abut while the edges of the side panel 88 of the box and the side panel 106 of the lid 82 abut, an infinitesimal slot will be formed along the abutting line of the side panels between the corner panels.

Figure 12:
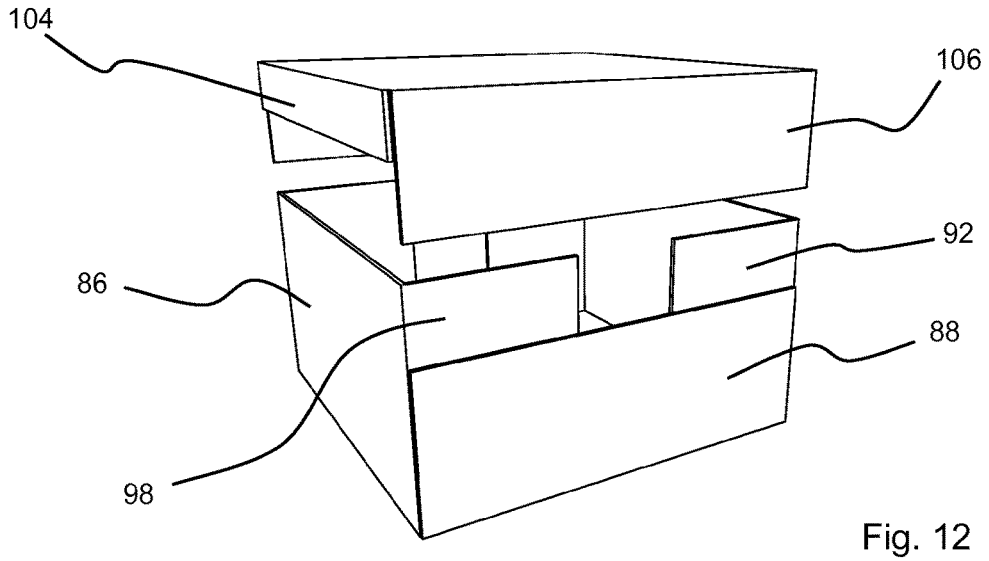
FIG. 12 is a perspective view of a box and a corresponding lid according to a fourth embodiment of the invention.
Figure 13:
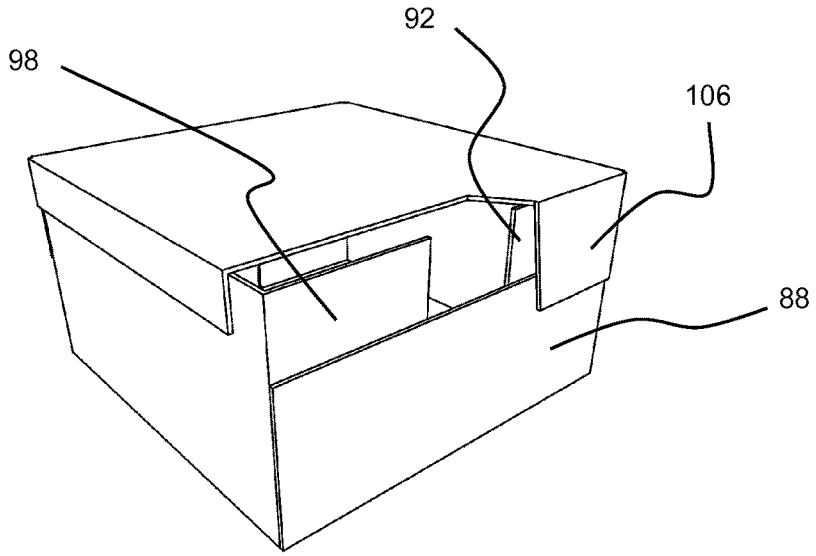
FIG. 13 shows the box and the lid of FIG. 12 in the closed state, wherein a part of the lid has been cut off to show certain details.
Figure 14:
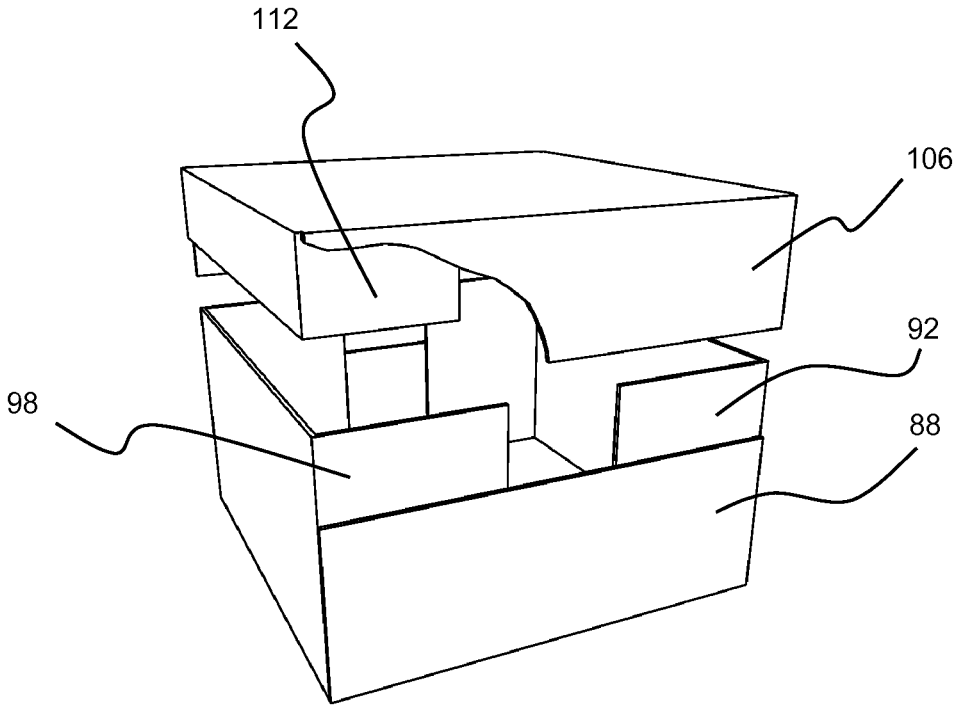
FIG. 14 is a perspective view of a box and a corresponding lid according to a fifth embodiment of the invention.

FIG. 12 and FIG. 13 show a situation, where the opposite first and second corner panels 92 and 98 do not abut, but as the side panels of the lid 82, of which only side panel 106 is visible, overlap the respective side panels 88 and 90 of the box, no infinitesimal slot or "hole" is formed and the box can be securely closed at all sides for example by simply gluing the side panels of the lid to the respective side panels of the box. However, in a situation like the one shown in FIGS. 12 and 13, where the side panels of the lid overlap the side panels of the box a gap of the thickness of the cardboard used for the box, is formed between the corner panels of the box and the side panels of the lid. This has generally no effect, but makes the lid slightly depressible at the edges of the side panels, which have no support by the side panels of the box. If either for reasons of stability or high-value boxes this is not wanted, the invention allows that lids are created having the layout of the box, i.e. where the corners between adjacent side and end panels are not cut away and instead four corner panels, of which one corner panel 112 is visible in FIG. 14, are formed. If the thickness of the cardboard used for the lid is the same as the thickness of the cardboard used for the box, the corner panels will fill the gap between the side panels of the lid and the corner panels of the box such that a high-value and very stable box is formed. However, according to the invention it is generally preferred to use lids without corner panels, as these lids are easier and hence faster to automatically fold on a respective box, allowing a high throughput for automatically packaging items in a box.

Figure 15:
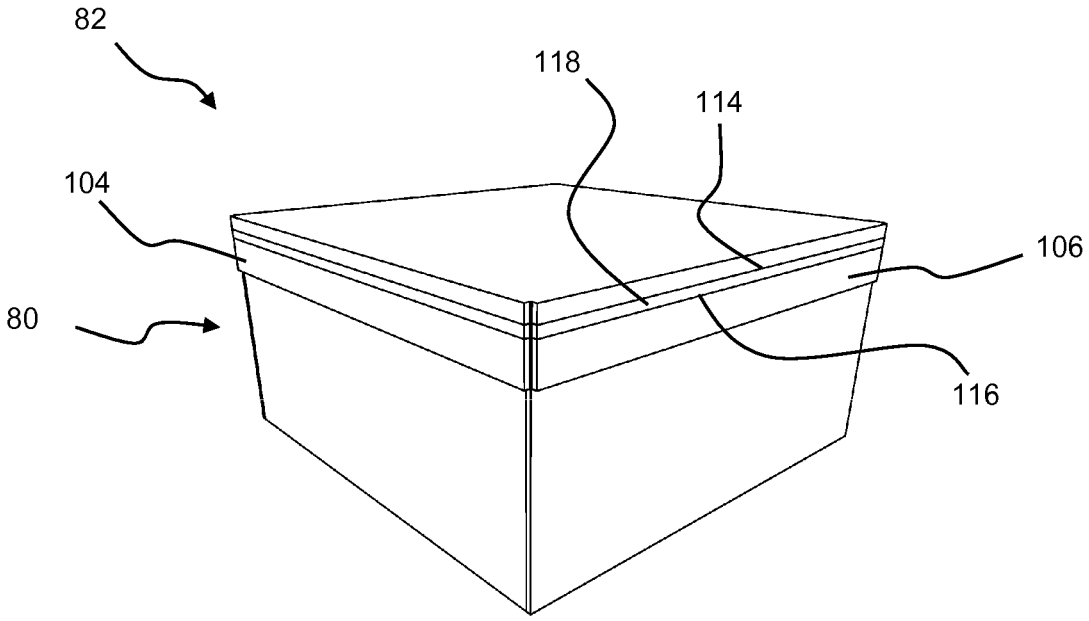
FIG. 15 shows a box according to the invention in a closed state, when the lid has been provided with perforated lines facilitating opening the lid.

FIG. 15 shows a box 80 with a lid 82 placed on top of it. Some of the panels of the lid, in this embodiment both end panels (only one end panel 104 is visible in this view) and one side panel 106 have been provided with parallel perforated lines 114, 116, which allow that the cardboard 118 between the perforated lines can easily be torn off to open the box. This tearing of can be enhanced by placing a tear off strip of tear-resistant material between the parallel lines, but in most cases providing the perforated lines is perfectly sufficient.

While in the embodiments shown in the figures the lid is generally placed on top of the end panels and the corner panels of the box, it is also possible to hold the lid above the box and to adhere the side and end panels of the lid to the respective side and end panels of the box such that the upper edges of the end panels and the corner panels of the box do not abut against the top panel of the lid, such that the total height of the box is greater than the height of the end panels of the box.

The boxes according to the invention shown in the drawings are simple and fast to be formed automatically. The dimensions of a corresponding blank can easily be calculated either from dimensions of the items to be packaged known from a database or by simply putting the items to be shipped on a conveyor belt, transporting the item(s) through a laser scanner, which determines the width, height and length respectively the arrangement of items and calculates the desired minimum dimensions of a box. These dimensions can be optimized taking into account numerous optimisation criteria like for example minimum volume of the closed box, maximum strength of the closed box, minimum waste material, position of fold lines from zig-zag folded cardboard. If the cardboard is supplied from a stack of zig-zag folded cardboard, the cardboard comprises fold lines where the cardboard is zig-zag folded. These fold lines can be adverse for folding a box or a lid when the present fold lines are close to a crease line that has to be formed for defining respective panels of the lid or the box. A control unit can easily obtain information about the position of such "unwanted crease lines" (the fold lines present due to zig-zag folding), and can adapt the dimensions of a box or a lid so that a certain minimum distance, which depends on the properties of the cardboard, is kept between unwanted and wanted crease lines.

The dimensions of the box will typically be calculated based on the desired minimum dimensions such that: the inner length of the bottom panel corresponds to the desired length plus some tolerance value, the inner width of the bottom panel corresponds to the desired width plus some tolerance, the inner height of the end panels may correspond to the desired height plus some tolerance or may, if the lid shall not abut against the end panels, may be less that the desired height. All other dimensions follow from this automatically.

A respective system for folding and cutting the cardboard to create lids and boxes comprises structure for cutting (which may also include die cutting), like rotating or reciprocating knifes, lasers, die cutters etc., structure for creasing, like crease rollers or moving stamps, and structure for folding the cardboard, like moveable grippers and flaps, and preferably structure for attaching the respective panels to each other, like a glue unit for applying hot melt glue to one or both of overlapping panels, and/or an adhesive strip application unit. In a preferred embodiment, only hot melt glue is used for attaching the panel of the box to each other and for closing the box by attaching the end and side panels of the lid to the respective panels of the box. The slots mentioned above between the corner panels and the side panels can be cut out or punched out and accordingly structure for cutting includes structure for so called die cutting i.e. punching. Likewise, the corners of the lid between adjacent side and end panels, which are generally not wanted unless the lid shall comprise corner panels as described above, can either be cut or punched away.

Figure 16:
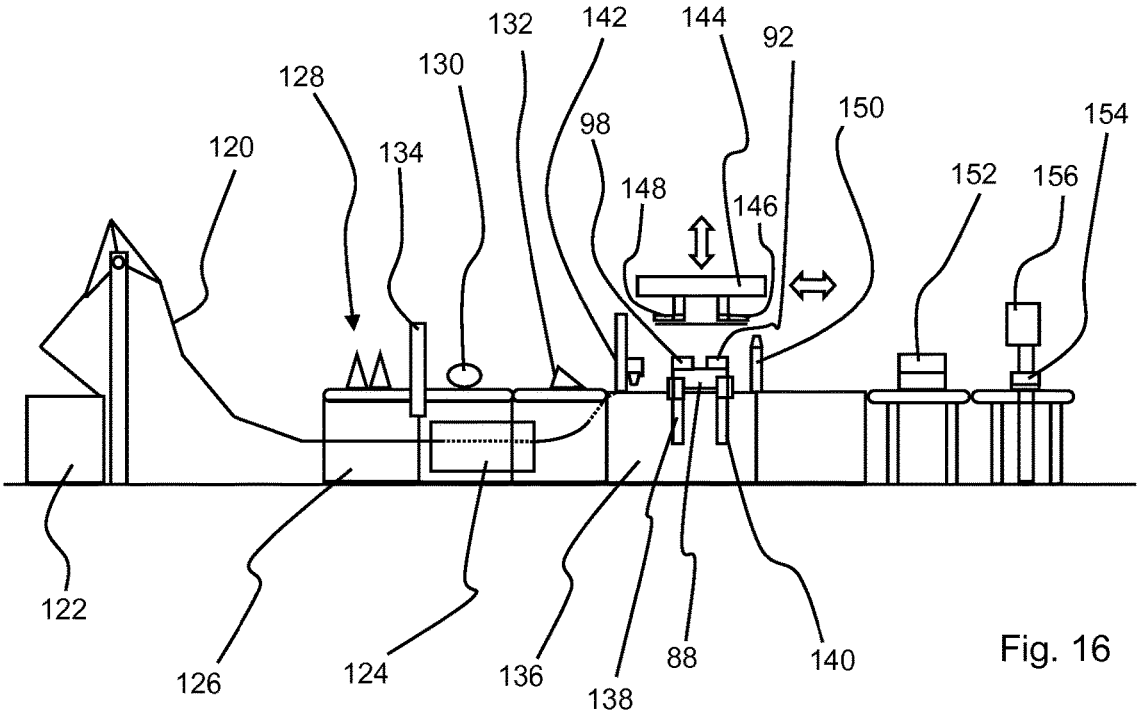
FIG. 16 is a schematic diagram of a system according to a first embodiment of the invention.

FIG. 16 is a schematic diagram showing a system according to the invention. Cardboard 120 is supplied from a stack 122 of zig-zag folded cardboard to a station 124 for cutting the cardboard, punching out slots between the corner panels and the side panels and introducing crease lines to delimit the respective panels from each other and to thus produce a blank for a custom-sized box. The respective dimensions of the panels are calculated as set forth above, and the system comprises for this purpose a calculating unit, which can form part of a control unit for controlling the complete system and which may for example be integrated in a receiving unit 126, where items like the items 128, 130 and 132, which shall be packaged, are placed either automatically or manually. The items to be packaged are transported via conveyor belts through a laser scanning unit 134, which measures the outer dimensions of the items passing through the unit in order to obtain information on the desired inner dimensions length $L_D$, width $W_D$ and height $H_D$ a box needs to have in order to receive the items or the arrangement of items as they are, i.e. without re-arranging the items. Of course, the system could also be provided with structure for arranging the items in a certain manner for example to reduce the volume needed. However, in this schematic drawing a simple and fast working embodiment is shown. The cardboard blank is transported from the cutting and creasing station 124 to a folding station 136, where the item or the items to be packaged are put on top of the bottom panel of the respective blank cut and creased in the cutting and creasing station. Respective grippers and folders like the gripping and folding units 138 and 140 fold the box around the item(s) to be packaged as described above, i.e. erect all four corner panels, of which two, namely corner panels 92 and 98, are visible in this view upwards, then fold the end panels inwards thus folding also the corner panels inwards and finally the side panels, of which side panel 88 is visible in this view, upwards.

When the respective blank is transported from the station 124 to the station 136, it passes a glue application unit 142, which applies hot melt glue to the parts of the side panels, which are to be brought into contact with the corner panels.

To close the box, in this embodiment a lid placing station 144 is provided, which as indicated by the double-sided arrows is moveable upwards and downwards, forwards and rewards in the transport direction of the items respectively the boxes. Similar to the blanks for the box, based on the calculated dimensions a blank for the lid is produced and picked up by the lid placing station 144 for example with suction grippers that can be integrated in respective folding units 146 and 148 of the lid placing station. A gluing unit 150 applies hot-melt glue to the end panels and the side panels of the lid, which is placed on top of the box that just has been erected, upon which the end panels and the side panels of the lid are folded downwards. The thus closed boxes 152, 154 are then transported via respective conveyor belts to a label printing and application unit 156, which puts a label including for example address of the recipient and postage on the boxes, which then can be picked up and further transported. The lid can be created from the same cardboard supplied as the box, in case of which the cutting and creasing station may be set up to produce not only a blank for the box, but also a blank for the lid, which may then be transported via respective conveyor belts to the lid placing station, which picks up the lid and puts it on top of the box.

Figure 17:
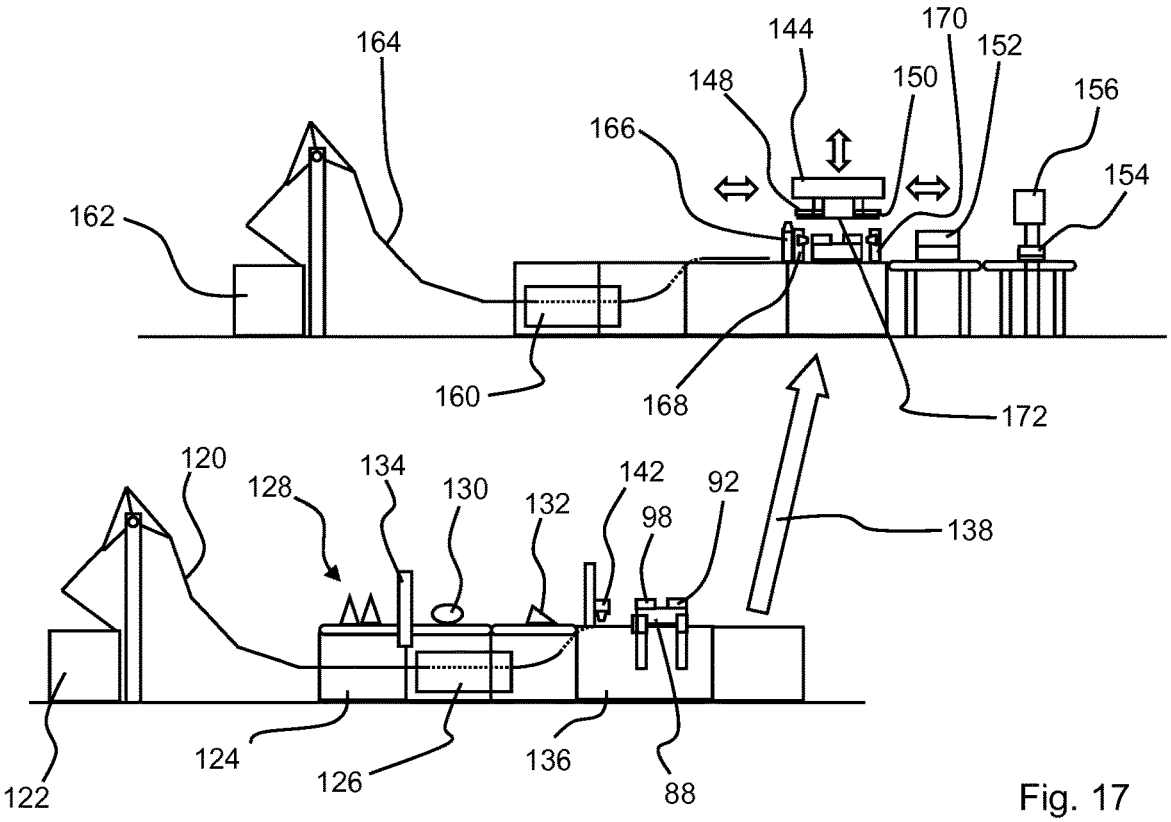
FIG. 17 is a schematic diagram of a system according to a second embodiment of the invention.

FIG. 17 schematically shows an embodiment of a system according to the invention, which comprises separate production lines for producing the boxes and the lids, which could increase the through-put of the system. As in FIG. 16, items 128, 130 132 are scanned, blanks are produced from cardboard 120 and boxes are folded around the items via respective stations 124, 126, 136 as shown in FIG. 16. However, the boxes are then transported as indicated by arrow 138 to a lid creation and placing line, in which lids are produced more or less parallel to producing the boxes. Like the box creation line, the lid production line comprises a station for cutting and creasing the cardboard 160 supplied from a stack 162 of cardboard 164, which may correspond to the cardboard used for producing the boxes or which may have different properties, in particular different widths, strengths, branding etc. It is also possible to provide the lid production line with different cardboard supplies so that depending for example on the dimensions needed for a respective lid, a cardboard can be chosen that allows to reduce the amount of waste produced upon producing the lid. As described above, it may be that the lid is cut out from the cardboard supplied in a "rotated" manner, i.e. such that seen in the transport direction of the cardboard the side panels are in front and in the rear of the top panel of the lid, whereas the end panels are to the left and the right of the top panel. In order to properly align the box and the lid, the system may comprise a box rotating unit, in which during transporting the box from the box line to the lid production and placing line the box is rotated, if necessary, by 90° in order to align the lid and the box. As is apparent from the present application, of course instead of rotating the box, if is necessary at all, the lid may be rotated by 90°.

Both production lines comprise glue application units 142, 166, 168 and 170. In this embodiment, the lid placing station 144 comprises a separate glue unit 166 for applying hot-melt glue to the side panels in the transport direction of the cardboard of the lid 172 to be placed on a box, and two glue units 168 and 170 for applying holt-melt glue to the end panels of the box where the end panels of the lid have to be attached to the box.

The invention claimed is:

1. A method for making custom-sized open packaging boxes from cardboard having a width $W_{CBB}$ and corresponding separate closing lids from cardboard having a width $W_{CBL}$, the cardboard being continuously supplied to a system comprising structure for cutting, creasing and folding the cardboard to form custom-sized boxes and corresponding lids such that each box comprises a rectangular bottom panel having four edges, a first and a second rectangular end panel joined via respective crease lines to opposite edges of said bottom panel, a first and a second rectangular side panel joined via respective crease lines to opposite edges of said bottom panel, two first and two second rectangular corner panels, the first corner panels joined via respective crease lines to opposite edges of the first end panel, and the second corner panels joined via respective crease lines to opposite edges of the second end panel, each lid comprises a rectangular top panel having four edges, a first and a second rectangular end panel joined via respective crease lines to opposite edges of said top panel, a first and a second rectangular side panel joined via respective crease lines to opposite edges of said top panel, optionally two first and two second rectangular corner panels, the first corner panels joined via respective crease lines to opposite edges of the first end panel and the second corner panels joined via respective crease lines to opposite edges of the second end panel, said method comprising:

obtaining information that specifies a set of minimum inner dimensions of a box to be created, the set of minimum inner dimensions including a length $L_D$, a height $H_D$ and a width $W_D$ of the box to be created, calculating a set of dimensions of the panels of the box to be created and of the panels of a lid to be created based on the set of minimum inner dimensions taking into account defined optimization criteria, and creating the box and the lid based on the set of dimensions of the panels of the box to be created and of the panels of the lid to be created, wherein said calculating comprises allowing an inner height $H_{SPB}$ of the side panels of the box to be smaller than the inner height $H_D$ of the box if $(W_D+2\ T_{CBB}\ 2H_D)>(W_{CBB}-M_B)$, wherein $M_B$ denotes an optional minimum margin that is cut off at the sides of the cardboard supplied and wherein $T_{CBB}$ denotes a material dependent correction factor that at least approximately corresponds to a thickness of the cardboard used to form the box, and/or if $2H_D>L_D$ and choosing an inner height $H_{SPL}$ of the side panels of a lid template so that the inner height $H_{SPB}$ of the side panels of the box plus the inner height $H_{SPL}$ of the side panels of the lid equals at least the height specified by the set of minimum inner dimensions of the box to be created.

2. The method according to claim 1 for making custom-sized open packaging boxes from cardboard having the width $W_{CBB}$ and corresponding separate closing lids from cardboard having the width $W_{CBL}$, the cardboard being continuously supplied to a system comprising structure for cutting, creasing and folding the cardboard to form custom-sized boxes and corresponding lids such that each box comprises:

a rectangular bottom panel having four edges, an inner length $L_{BPB}$ and an inner width $W_{BPB}$, a first and a second rectangular end panel joined via respective crease lines to opposite edges of said bottom panel, each end panel having an inner width $W_{EPB}$ and an inner height $H_{EPB}$, a first and a second rectangular side panel joined via respective crease lines to opposite edges of said bottom panel, each side panel having a length $L_{SPB}$ and the inner height $H_{SPB}$, two first and two second rectangular corner panels, the first corner panels joined via respective crease lines to opposite edges of the first end panel, and the second corner panels joined via respective crease lines to opposite edges of the second end panel, each corner panel having an inner length $L_{CPB}$ and a height $H_{CPB}$, each lid comprises:

a rectangular top panel having four edges and a length $L_{TPL}$ and a width $W_{TPL}$, a first and a second rectangular end panel, joined via respective crease lines to opposite edges of said top panel, each end panel having a width $W_{EPL}$ and an inner height $H_{EPL}$, a first and a second rectangular side panel joined via respective crease lines to opposite edges of said top panel, each side panel having a length $L_{SPL}$ and the inner height $H_{SPL}$, optionally two first and two second rectangular corner panels, the first corner panels joined via respective crease lines to opposite edges of the first end panel and the second corner panels joined via respective crease lines to opposite edges of the second end panel, each corner panel having an inner length $L_{CPL}$ and a height $H_{CPL}$, wherein calculating comprises setting, if $(W_D+2\ T_{CBB}+2H_D)>(W_{CBB}-M_B)$, wherein $M_B$ denotes an optional minimum margin that is cut off at the sides of the cardboard supplied for creating the box and wherein $T_{CBB}$ denotes a material dependent correction factor generally corresponding to the thickness of the cardboard used for the box, and/or if $2H_D>L_D$ $H_{SPB}$ to fulfil $(2H_{SPB}+2\ T_{CBB}+W_{BPB})\leq(W_{CBB}-M_B)$ and $2H_{SPB}\leq L_D$ and $H_{SPL}$ to fulfil $H_{SPL}+H_{SPB}\geq H_D$.

3. The method according to claim 1, wherein the bottom panel of each box has an inner width $W_{BPB}$, and if $(W_D+2\ T_{CBB}+2H_D)>(W_{CBB}-M_B)$ and/or if $2H_D>L_D$, $H_{SPB}$ is set to, within the typical material-caused tolerances, $(2H_{SPB}+2T_{CBB}+W_{BPB})=(W_{CBB}-M_B)$ if $(W_D+2\ T_{CBB}+2H_D)>(W_{CBB}-M_B)$ and if $2H_D\leq L_D$, $(1H_{SPB}+1\ T_{CBB})=\frac{1}{2}L_D$ if $(W_D+2\ T_{CBB}+2H_D)\leq(W_{CBB}-M_B)$ and if $2H_D>L_D$; and to the minimum of the above if $(W_D+2\ T_{CBB}+2H_D)>(W_{CBB}-M_B)$ and if $2H_D>L_D$.

4. The method according to claim 1, wherein the top panel of each lid has an inner length $L_{TPL}$ and an inner width $W_{TPL}$, and each end panel of each lid has an inner height $H_{EPL}$, and $H_{SPL}$ and $H_{EPL}$ are set to be equal if either $(L_{TPL}+2\ T_{CBL}+2H_{EPL})\leq(W_{CBL}-M_L)$ or $(W_{TPL}+2\ T_{CBL}+2H_{SPL})\leq(W_{CBL}-M_L)$, wherein $M_L$ denotes an optional minimum margin that is cut off at the sides of the cardboard supplied for creating the lid and wherein $T_{CBL}$ denotes a material dependent correction factor generally corresponding to the thickness of the cardboard used for the lid.

5. The method according to claim 4, wherein if both, $(L_{TPL}+2\ T_{CBL}+2H_{EPL})\leq(W_{CBL}-M_L)$ and $(W_{TPL}+2\ T_{CBL}+2H_{SPL})\leq(W_{CBL}-M_L)$, the lid is cut such that the side panels of the lid are in front and behind the top panel and the end panels of the lid are to the left and the right of the top panel seen in the transport direction of the cardboard supplied for making the lid, if $(L_{TPL}+2H_{EPL})>(W_{TPL}+2H_{SPL})$, and such that the end panels of the lid are in front and behind the top panel and the side panels of the lid are to the left and the right of the top panel seen in the transport direction of the cardboard supplied for making the lid if $(L_{TPL}+2H_{EPL})<(W_{TPL}+2H_{SPL})$.

6. The method according to claim 1, wherein the box and the lid are made in series from the same cardboard.

7. The method according to claim 1, wherein each side panel of each box has an inner height $H_{SPB}$, and each end panel of each lid has an inner height $H_{EPL}$, and if $H_{SPB}<H_D$, $H_{SPL}$ is set to fulfil, within the typical material-caused tolerances, $H_{SPL}+H_{SPB}=H_D$, and/or wherein if $H_{EPB}<H_D$, $H_{EPL}$ is set to fulfil, within the typical material-caused tolerances, $H_{EPL}+H_{EPB}=H_D$.

8. The method according to claim 1, wherein each side panel of each box has an inner height $H_{SPB}$, and each end panel of each lid has an inner height $H_{EPL}$, and $H_{SPL}$ is set to fulfil, within the typical material-caused tolerances, $H_{SPB}+H_{SPL}=H_D+M_{OSP}$, wherein $M_{OSP}$ denotes a desired overlap of the side panels of the lid with the side panels of the box, and/or wherein $H_{EPL}$ is set to fulfil, within the typical material-caused tolerances, $H_{EPL}+H_{EPB}=H_D+M_{OEP}$, wherein $M_{OEP}$ denotes a desired overlap of the end panels of the lid with the end panels of the box.

9. The method according to claim 1, further comprising: introducing two parallel perforation lines in at least some of the panels of the lid and optionally attaching a tear strip between the parallel perforation lines.

10. The method according to claim 1, further comprising: optimizing the dimensions of the panels of the box and the lid under at least one of the following criteria: minimum volume of the closed box, maximum strength of the closed box, minimum waste material, position of fold lines in zig-zag folded cardboard.

11. The method according to claim 1, further comprising: folding the corner panels of the box upwards with one or more items to be packaged on the bottom panel of the box, folding the end panels of the box upwards and the corner panels inwards, and folding the side panels upwards and placing the corresponding lid on top of the box.

12. The method according to claim 11, wherein placing the lid on the box comprises placing the top panel of the lid on the box and folding the end panels and the side panels of the lid downwards.

13. The method according to claim 11, wherein closing the box comprises holding the lid above the box and attaching the end panels of the lid to the end panels of the box and the side panels of the lid to the side panels of the box.

14. The method according to claim 11, wherein the corner panels and the side panels are glued to each other.

15. A system for making custom-sized open packaging boxes from cardboard having a width $W_{CBB}$ and corresponding separate closing lids from cardboard having a width $W_{CBL}$, the cardboard being continuously supplied to the system, wherein:

each box comprises:

a rectangular bottom panel having four edges, an inner length $L_{BPB}$ and an inner width $W_{BPB}$, a first and a second rectangular end panel joined via respective crease lines to opposite edges of said bottom panel, each end panel having an inner width $W_{EPB}$ and an inner height $H_{EPB}$, a first and a second rectangular side panel joined via respective crease lines to opposite edges of said bottom panel, each side panel having a length $L_{SPB}$ and an inner height $H_{SPB}$, two first and two second rectangular corner panels, the first corner panels joined via respective crease lines to opposite edges of the first end panel, and the second corner panels joined via respective crease lines to opposite edges of the second end panel, each corner panel having an inner length $L_{CPB}$ and a height $H_{CPB}$, each lid comprises:

a rectangular top panel having four edges and a length $L_{TPL}$ and a width $W_{TPL}$, a first and a second rectangular end panel, joined via respective crease lines to opposite edges of said top panel, each end panel having a width $W_{EPL}$ and an inner height $H_{EPL}$, a first and a second rectangular side panel joined via respective crease lines to opposite edges of said top panel, each side panel having a length $L_{SPL}$ and an inner height $H_{SPL}$, optionally two first and two second rectangular corner panels, the first corner panels joined via respective crease lines to opposite edges of the first end panel and the second corner panels joined via respective crease lines to opposite edges of the second end panel, each corner panel having an inner length $L_{CPL}$ and a height $H_{CPL}$, said system comprising:

at least one of a database and/or a non-contact dimensioner, to obtain information that specifies a set of minimum inner dimensions of a box to be created, the set of minimum inner dimensions including a length $L_D$, a height $H_D$ and a width $W_D$ of the box to be created, a calculating unit operable to calculate a set of dimensions of the panels of the box and of the panels of the lid based on the set of minimum inner dimensions taking into account a set of defined optimization criteria, wherein said calculating unit is adapted to set, if $(W_D+2T_{CBB}+2H_D)>(W_{CBB}-M_B)$, wherein $M_B$ denotes an optional minimum margin that is cut off at the sides of the cardboard supplied for creating the box and wherein $T_{CBB}$ denotes a material dependent correction factor generally corresponding to the thickness of the cardboard used for the box, and/or if $2H_D>L_D$ $H_{SPB}$ to fulfil $(2H_{SPB}+2T_{CBB}+W_{BPB})\leq(W_{CBB}-M_B)$ and $2H_{SPB}\leq L_D$ and $H_{SPL}$ to fulfil $H_{SPL}+H_{SPB}\geq H_D$.

16. The system according to claim 15, wherein the calculating unit is adapted to perform at least one of the following settings:

if $(W_D+2T_{CBB}+2H_D)>(W_{CBB}-M_B)$ and/or if $2H_D>L_D$, setting $H_{SPB}$ to fulfil, within the typical material-caused tolerances, $(2H_{SPB}+2T_{CBB}+W_{BPB})=(W_{CBB}-M_B)$, setting $H_{SPL}$ and $H_{EPL}$ to be equal if either $(L_{TPL}+2T_{CBL}+2H_{EPL})\leq(W_{CBL}-M_L)$ or $(W_{TPL}+2T_{CBL}+2H_{SPL})\leq(W_{CBL}-M_L)$, wherein $M_L$ denotes an optional minimum margin that is cut off at the sides of the cardboard supplied for creating the lid and wherein $T_{CBL}$ denotes a material dependent correction factor generally corresponding to the thickness of the cardboard used for the lid, setting $H_{SPL}$ to fulfil, within the typical material-caused tolerances, $H_{SPL}+H_{SPB}=H_D$, and/or $H_{EPL}$ to fulfil, within the typical material-caused tolerances, $H_{EPL}+H_{EPB}=H_D$, setting $H_{SPL}$ to fulfil, within the typical material-caused tolerances, $H_{SPB}+H_{SPL}=H_D+M_{OSP}$, wherein $M_{OSP}$ denotes a desired overlap of the side panels of the lid with the side panels of the box, and/or setting $H_{EPL}$ is set to fulfil, within the typical material-caused tolerances, $H_{EPL}+H_{EPB}=H_D.+M_{OEP}$, wherein $M_{OEP}$ denotes a desired overlap of the end panels of the lid with the end panels of the box.

17. The system according to claim 15, further comprising: structure for cutting, creasing, and folding the lid which structure is adapted to cut the lid, if both, $(L_{TPL}+2T_{CBL}+2H_{EPL})\leq(W_{CBL}-M_L)$ and $(W_{TPL}+2T_{CBL}+2H_{SPL})\leq(W_{CBL}-M_L)$, such that, if $(L_{TPL}+2H_{EPL})>(W_{TPL}+2H_{SPL})$, the side panels of the lid are in front and behind the top panel and the end panels of the lid are to the left and the right of the top panel seen in the transport direction of the cardboard supplied for making the lid, and such that, if $(L_{TPL}+2H_{EPL})<(W_{TPL}+2H_{SPL})$, the end panels of the lid are in front and behind the top panel and the side panels of the lid are to the left and the right of the top panel seen in the transport direction of the cardboard supplied for making the lid.

18. The system according to claim 15, further comprising structure for cutting, creasing, and folding to create the box and the lid in series from the same cardboard supplied to the system.

19. The system of claim 15, further comprising: a number of crease rollers or perforation rollers for introducing two parallel perforation lines in at least some of the panels of the lid and structure for attaching a tear strip between the parallel perforation lines.

* * * * *